US005285666A

United States Patent [19]

Bartnicki

[11] Patent Number: 5,285,666

[45] Date of Patent: Feb. 15, 1994

[54] COMBINED DEAD LOCK AND SAFETY CHAIN TYPE DOOR LOCK

[76] Inventor: Arthur W. Bartnicki, 800 Victoria Sq. C.P. 403, Montreal, Quebec, Canada, H4Z 1J7

[21] Appl. No.: 864,899

[22] Filed: Apr. 2, 1992

[30] Foreign Application Priority Data

Apr. 16, 1991 [CA] Canada ..... 2040618

[51] Int. Cl.[5] ..... E05C 17/36

[52] U.S. Cl. ..... 70/93; 292/264

[58] Field of Search ..... 70/89, 93; 109/60; 292/264

[56] References Cited

U.S. PATENT DOCUMENTS

| | | | |
|---|---|---|---|
| 2,881,611 | 4/1959 | Callegari | 70/93 |
| 2,970,465 | 2/1961 | Falk, Jr. et al. | 70/93 |
| 3,125,875 | 3/1964 | Friedman | 70/93 |
| 3,161,035 | 12/1964 | Adamec et al. | 70/93 |
| 3,395,556 | 8/1968 | Waldo | 70/93 |
| 3,894,762 | 7/1975 | Segal | 292/264 |
| 4,082,333 | 4/1978 | Segal | 292/264 |

FOREIGN PATENT DOCUMENTS

| | | | |
|---|---|---|---|
| 710033 | 5/1965 | Canada | 70/74 |
| 718626 | 9/1965 | Canada | 70/88 |
| 801377 | 12/1968 | Canada | 70/36 |
| 975026 | 9/1975 | Canada | 292/264 |
| 333931 | 3/1921 | Fed. Rep. of Germany | 70/93 |
| 22135 | of 1911 | United Kingdom | 70/93 |
| 6448 | of 1912 | United Kingdom | 70/93 |
| 21844 | of 1912 | United Kingdom | 70/93 |

*Primary Examiner*—Lloyd A. Gall

[57] ABSTRACT

A door locking mechanism of the chain guard type which can be used as a dead lock and in a manner similar to currently popular regular safety chain type door locks. The mechanism comprises a bolt keeper formed with at least one elongated slot terminating into at least one enlarged opening. A bolt matched in size and shape cooperates with this keeper and is inserted into the keeper through the opening and captively slides in it after insertion. The mechanism further includes a key operated lock having a lock member that can be secured to and released from the lock. A chain interconnects the lock member and the bolt and forms therewith a chain assembly having an operative length which is selectable between at least two positions. In one of these positions, the bolt can be removed from the keeper without freeing the lock member from the lock. In another position where the chain is in a fully stretched condition, with the bolt in the keeper and the look member secured to the key operated lock, the bolt cannot be removed from the keeper unless the lock member is freed from the lock by using the key.

7 Claims, 6 Drawing Sheets

COMBINED DEAD LOCK AND SAFETY CHAIN TYPE DOOR LOCK

BACKGROUND OF THE INVENTION

1. Field of the Invention

The present invention relates to a door locking mechanism of the chain guard type that permits holding a door partially ajar so as not to allow a person into the premises before the chain is released.

More particularly, the invention relates to a door looking mechanism which advantageously combines the features and advantages of both a standard dead lock and a safety chain type door lock.

2. Description of the Prior Art

There are numerous door locking mechanisms of the chain guard type presently available on the market, and numerous patents dealing with improvements thereto. Those believed to be most relevant to this invention are as per Canadian Patent numbers - 710 033-, -718 626-, - 801 377-, and U.S. Pat. Nos. 3,125,875, 3,161,035, and 3,395,556.

Other inventions, such as those described in British Patent 6448 of Mar. 15, 1912 and German Patent 333931 of Mar. 5, 1921 are relevant because they show that the dead lock advantage was a desireable feature even at these early dates.

Basically, each mechanism of this type comprises a chain secured at one end to a key operated lock which is attached to the door jamb. At its other end, the chain is provided with a bolt that is inserted and slid in a keeper provided for this purpose with an elongated slot terminating in an enlarged opening at the end of the slot away from the lock. The opening serves for the insertion of the bolt. When not in use the bolt is removed from the keeper.

This type of mechanism serves its purpose well so long as the occupant is present and on guard in the premises. It is however not completely effective when the occupant is absent, even though the bolt is in the keeper and the lock member is secured in the key operated lock. In such circumstances it is possible for an unauthorized person to cause the bolt to slide toward the enlarged opening of the keeper slot and have the bolt finally fall out of the keeper. The hand is used if the unauthorized person has managed to gain entry to the premises or a hand may be inserted via a broken window in the door. Alternatively an extension tool such as a coat hanger or rubber band with thumbtack can be used from outside. It is of course possible to overcome this drawback by shortening the chain but then the mechanism is no longer useful as a safety door lock since, in normal use, the partial door opening is decreased and may no longer be sufficient to allow a person on the inside to identify persons on the outside or to allow the passage of parcels and other articles or even inconvenience access with the key from the outside unless the chain is made free by using the key.

SUMMARY OF THE INVENTION

The object of the present invention is to provide a door locking mechanism of the chain guard type, wherein the effective operating length of the chain is selectable in such a manner that, in one position, the mechanism acts as any conventional safety chain type door lock and thus allows one to hold the door partially ajar and in the other position the same mechanism acts as a dead lock and thus makes it impossible for an unauthorized person working from the outside and even from the inside of the premises, to remove the bolt from its keeper and allow the door to be freely opened.

In detail, the door locking mechanism, according to the invention, basically comprises, a bolt keeper for mounting on a door. This keeper is formed with at least one elongated slot terminating, at one end only, with at least one enlarged opening. The keeper operates with a key operated lock for mounting on a door frame riser. This lock includes a lock member capable of being secured to and released from the lock by means of an ordinary key. The mechanism further comprises a chain assembly that includes a chain having one end fixed to the lock member and another end fixed to a bolt that is sized and shaped so as to be insertable into one of the enlarged openings at the end of the keeper and then to be captively slideable along the adjacent slot.

In accordance with the invention, the chain assembly has an effective operating length which allows use between at least two positions in such a manner that, in one of these positions, one can remove the bolt from the keeper without having to free the lock member from the lock and, in another one of these positions that even when the chain is in a fully stretched condition, with the bolt in the keeper and the lock member secured to the key operated lock, the bolt cannot be removed from the keeper unless the lock member is freed from the lock.

DESCRIPTION OF PREFERRED EMBODIMENTS

Figure 1B:
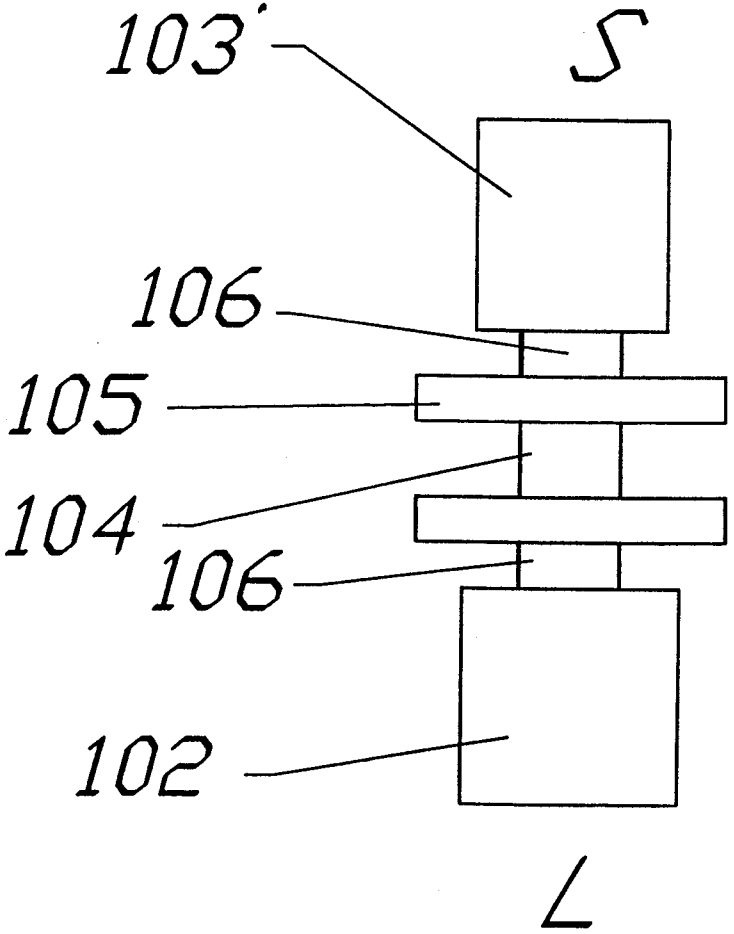
FIGS. 1A and 1B are a top plan view of a bolt for use in a locking mechanism according to the invention shown with and without a chain link.
Figure 1A:
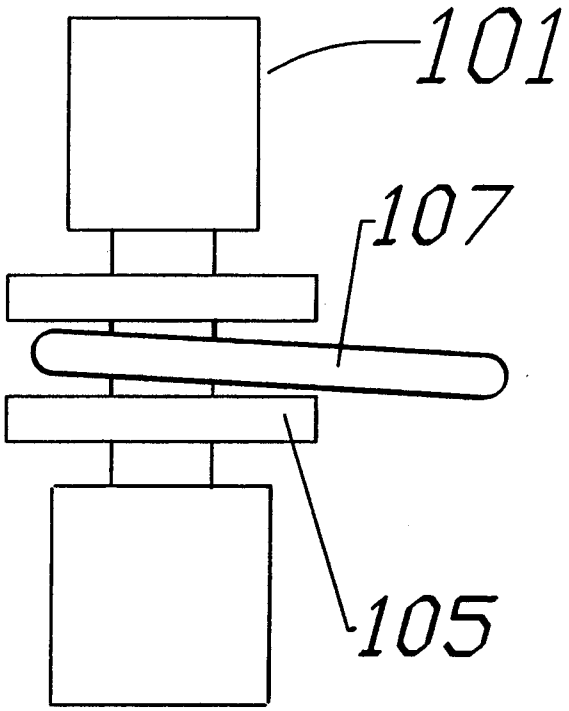

The bolt 101 shown in FIGS. 1A and 1B comprises a cylindrical knob 102 having a large diameter L, and a cylindrical knob 103 having a small diamter S, both cylinders being mounted either solidly or rotatably at the ends of a round trunnion or shaft 104 and 106. Also mounted on the trunnion is a pair of flanges 105 of larger diameter between which is secured the last link 107 of the chain.

Figure 2A:
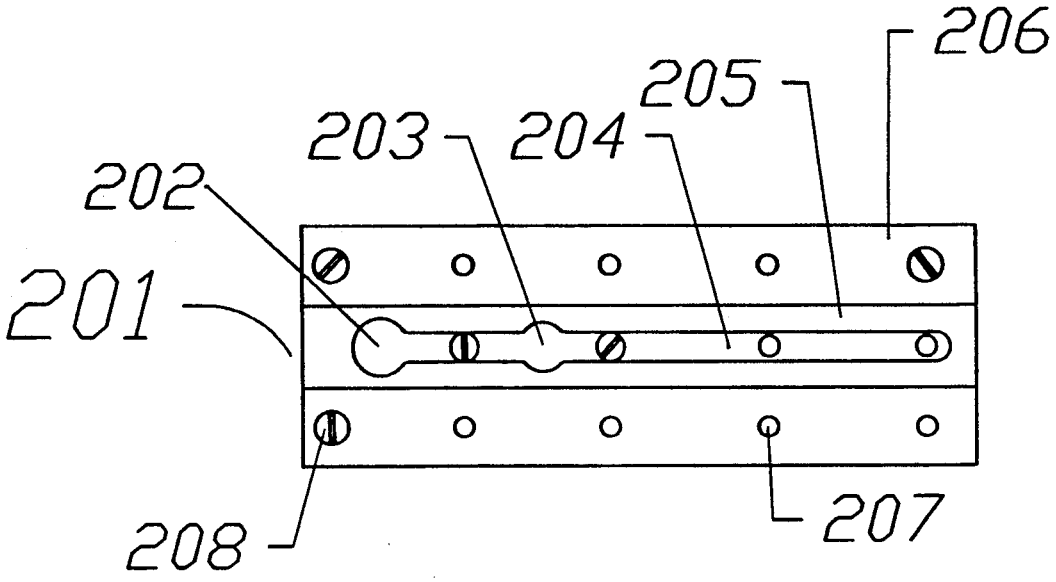
FIGS. 2A and 2B are a front elevation view of a keeper for the bolt shown in FIGS. 1A and 1B.
Figure 2B:
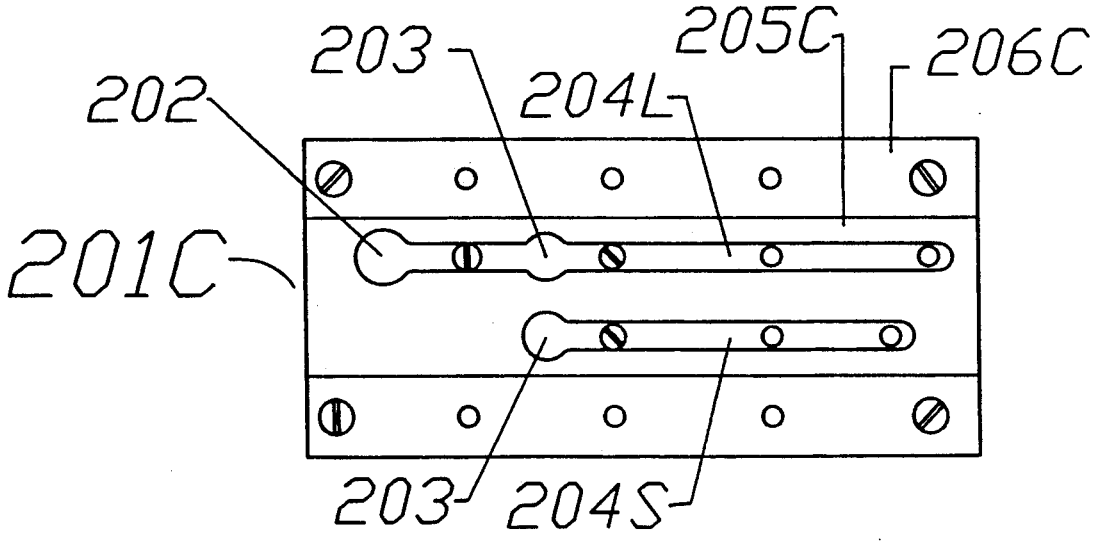
Figure 3A:
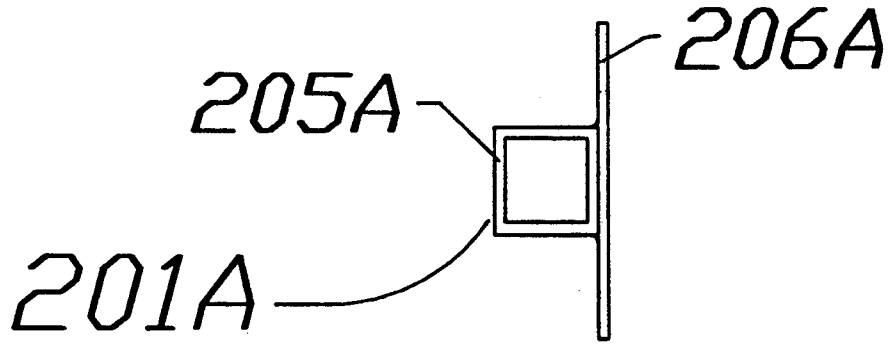
FIGS. 3A, 3B and 3C are side elevation views of two rectangular and a channel shaped keeper shown in FIGS. 2A and 2B.
Figure 3B:
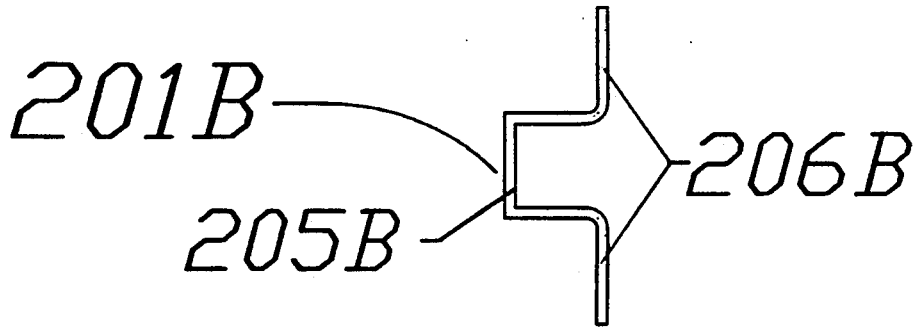
Figure 3C:
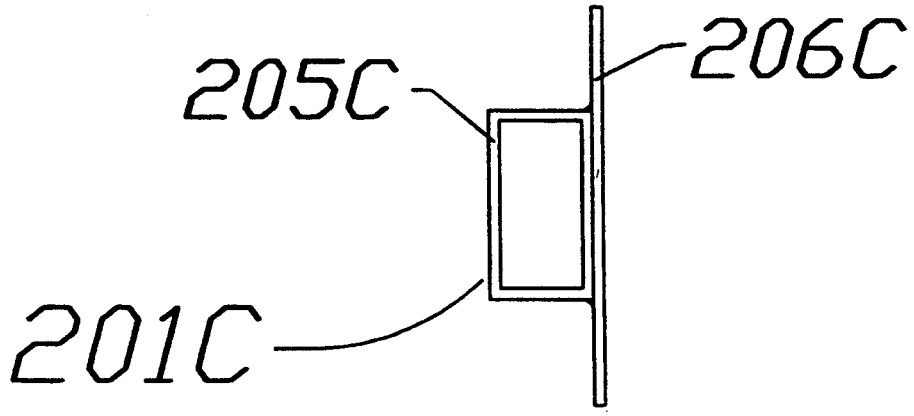

The companion keeper 201 of the bolt 101 is shown in FIGS. 2A, 2B, 3A, 3B and 3C. This keeper is in the form of a rectangular tube 205A or 205C with flange plate 206A, 206C attached or in the form of a channel member 205B with integral flanges 206B, that can be mounted on a door 401 as in FIGS. 4,5 and 6 by means of screws 208 inserted into the holes 207. The side 205A, 205B, 205C opposite the flanges 206A, 206B, 206C is formed with an elongated straight slot 204 terminating in a greatly enlarged outer circular opening 202 and a slightly enlarged inner circular opening 203. The openings 202 and 203 have diameters suitable to match those of the large knob 102 and of the small knob 103, respectively. These diameters are also obviously greater than the width of the slot 204 so that the knobs are held captive in the keeper 201, or 201C when sliding in it after insertion therein through one of the openings. Similarly the diameter of the trunnion 106 is selected so as to allow it to slide along the slot 204 without interference. Advantageously, the outer diameter of the flanges 105 is considerably greater than the diameters of the holes 202 and 203. Indeed these flanges 105 are intended to stay on the outside of the wall 205A, 205B,205C when the knobs 102 or 103 lie on the inside, and thus help in keeping the bolt 101 aligned during its travel within the slot of the keeper. FIG. 2B also shows keeper 201C with the new embodied slot 204L and holes 203 and 202 incorporated alongside a currently sized slot 204S and hole 203. It can be seen that the end of the new slot 204L is considerably closer to the door edge (right hand side) than is the end of slot 204S.

Figure 4:
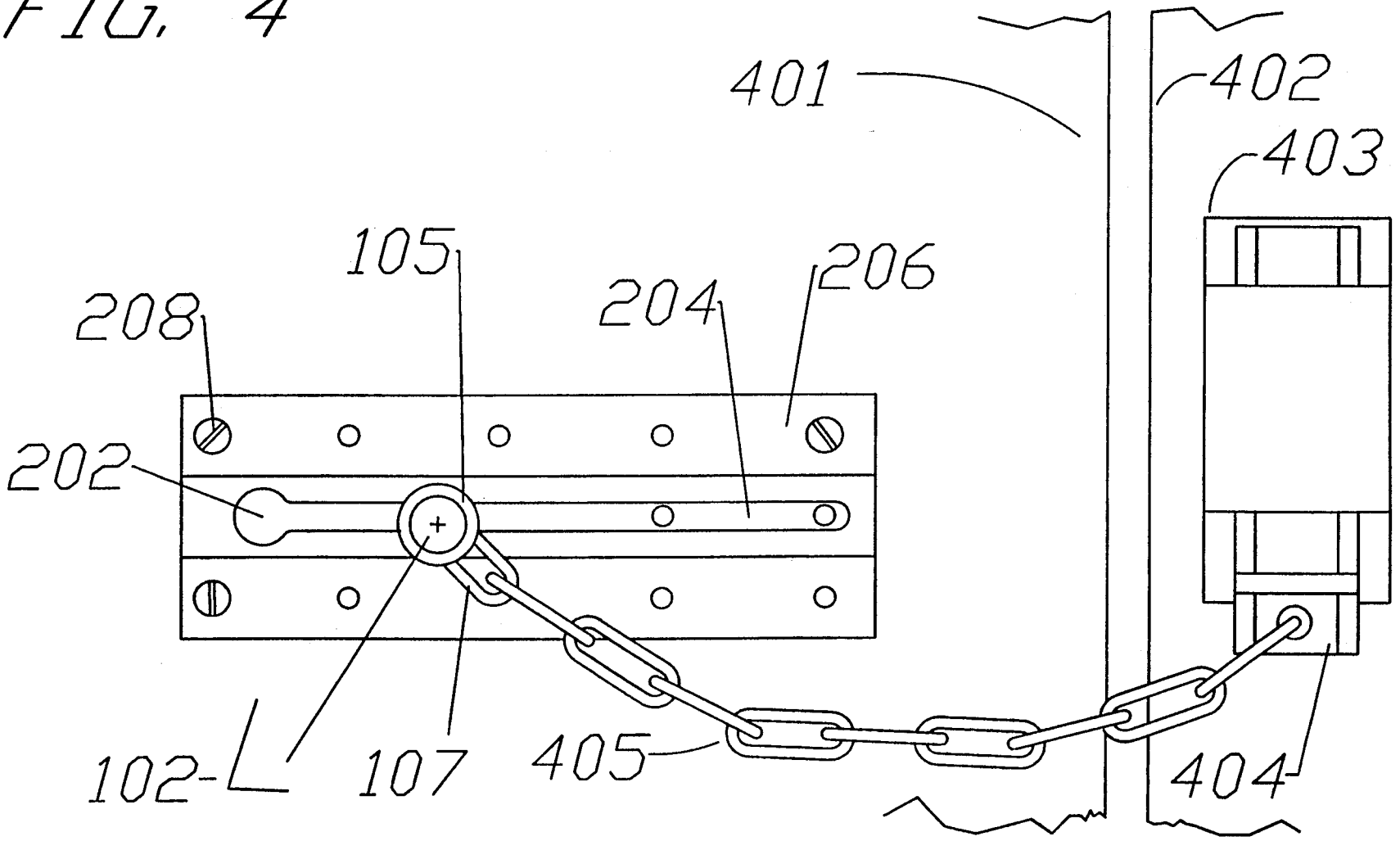
FIG. 4 is a front elevation view of a locking mechanism according to the invention which involves; the bolt assembly and keeper of FIGS. 1A, 1B, 2A, 2B, 3A, 3B, and 3C when used as a regular safety chain lock.

FIG. 4 shows a locking mechanism according to a preferred embodiment of the invention with the small knob 103, S being held by the keeper 201 and the large knob 102, L being on the outside. This mechanism also includes a conventional key operated lock 403 into which a lock member 404 attached to the other end of the chain 405 can be slid and secured until it is allowed to be removed by operation of a lock key. The lock 403 is secured to the door frame jamb 402 by means of screws.

To make the locking mechanism according to the invention useful as a conventional safety chain lock when the occupant is at home the chain 405 must be sufficiently long to allow the small knob 103 to be slid across the small opening 203 into the keeper 201 with the door 401 being closed. Yet the chain must be sufficiently short to allow only a relatively small opening of the door when the knob 103 reaches the bottom of the slot 204 away from the openings 202 and 203. FIG. 4 shows that the small knob is readily aligned with the small hole 203 and thus can be removed so that the door can be opened completely without the use of a key.

On the other hand, when the occupant is going to be absent, the mechanism should be made tamper proof against intruders who, from the outside or even the inside, may try to bring the knob 103 in alignment with the small opening 203 and thus free the bolt and consequently the door even with the lock member 404 secured in the lock 403.

In accordance with this particular embodiment of the invention, the tamper proof feature is obtained by turning the bolt 101 around so as to make use this time of the large knob 102, which can be inserted into the keeper 201 only through the large opening 202 and by having selected a chain 405 having a length sufficient to allow the large knob 102 to be removed from the keeper 201 through the opening 202 only when the look member 404 is free from the key operated lock 403.

Figure 5:
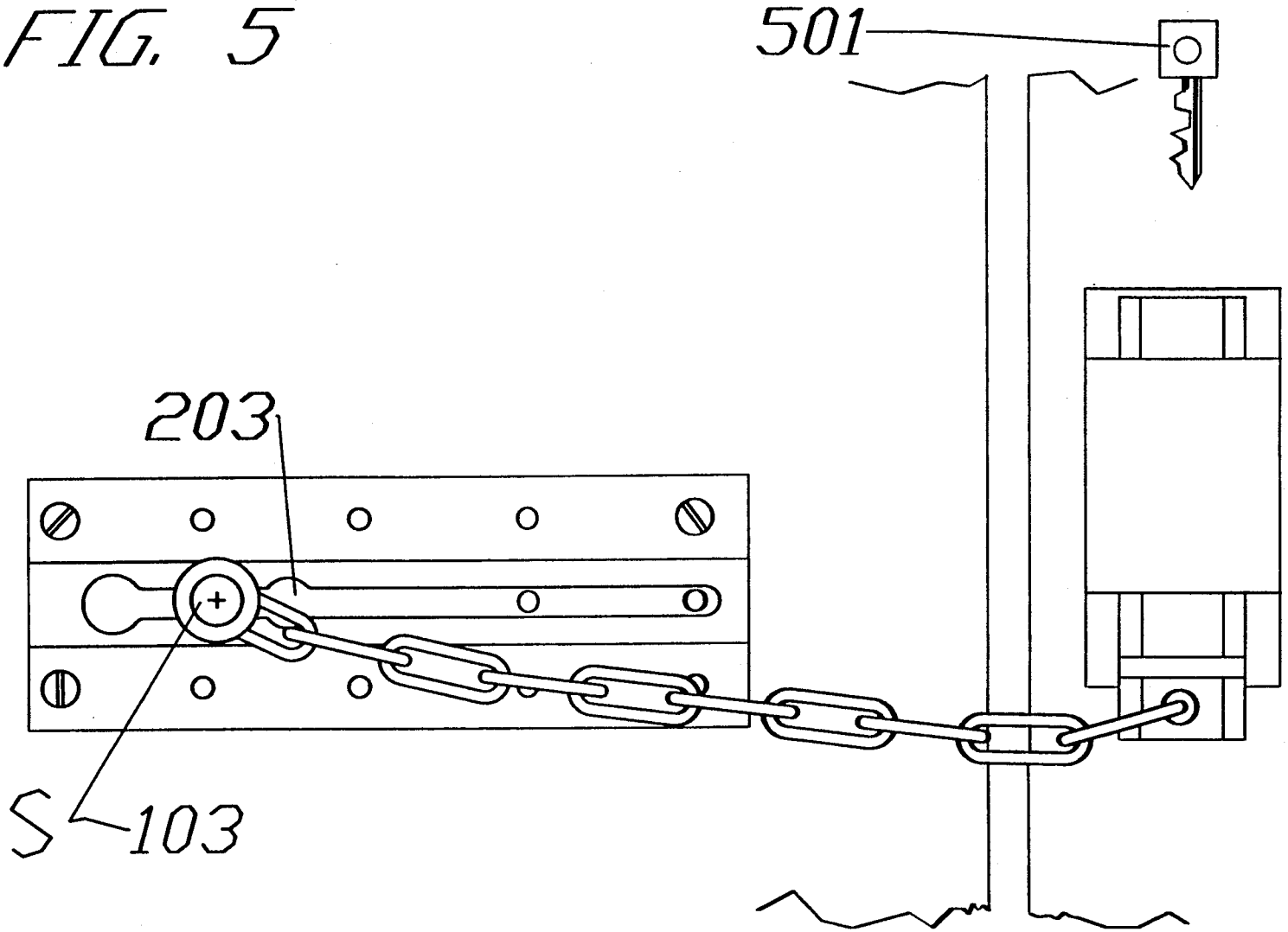
FIG. 5 is a front elevation view of the same locking mechanism as shown in FIG. 4, when used as a dead lock in a tamper proof manner showing that the key is required to open it.

In FIG. 5 the large knob 102 is seen as having been introduced through the large opening 202 and the small knob 103 is on the outside. To do so, the chain 405 being too short, it has been necessary to remove the lock member 404 from the lock 403. Now with the lock assembly in its deadlock configuration FIG. 5 shows that the chain is too short to permit alignment of the large knob with the large hole and it is necessary to use the key 501 to remove the lock member 404 from the lock 403 so that the door can be fully opened. Thus it has been shown how this mechanism has now been made tamper proof even though the end of the new slot can be placed closer to the door 401 edge than would be the regular currently used slot. This has the advantage of allowing the door to be opened wider for passage of parcels and still be tamper proof. If we use the keeper 201C in a similar arrangement to FIGS. 4, 5 and 6 we can still have a regularly currently used slot 204S with its hole 203 and restricted opening for passing letters and very small parcels plus the advantages of the new embodiment with its wider door opening and dead lock feature.

Figure 6:
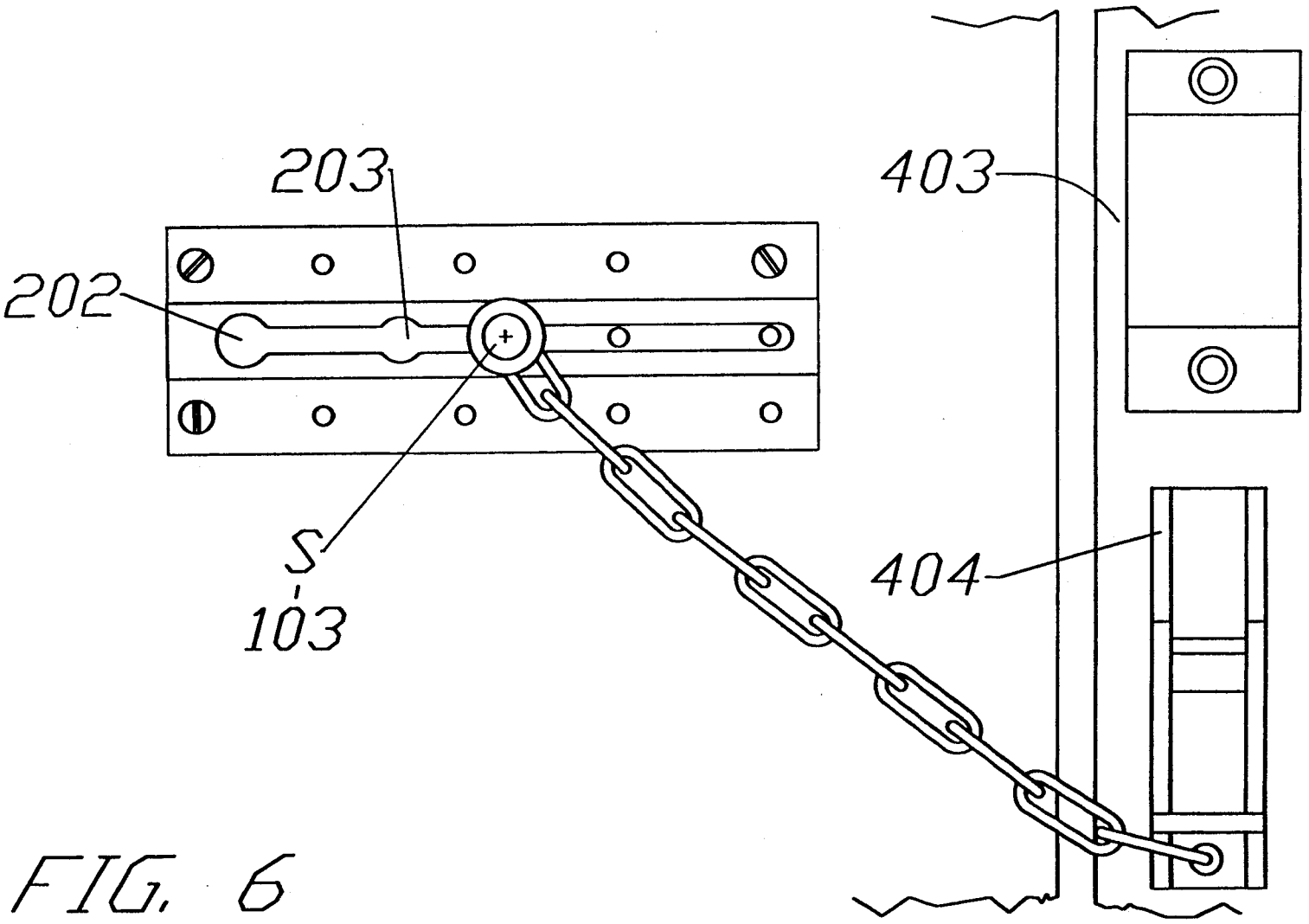
FIG. 6 is a front elevation view of the same lock as shown in FIG. 5 with the lock open.

FIG. 6 shows the lock member 404 is disengaged from the lock 403 after using the key 501.

In the just described arrangement, the chain assembly mentioned in the summary of the invention, includes the bolt 101 with its knobs 102, 103, trunnion 104, 106 flanges 105, and the chain 405, fixed to the lock member 404. Conventional key operated lock is not part of this invention.

While I have shown and described an actual working prototype of the chain door lock, it will be understood that the same is capable of modification without departure from the spirit and scope of the invention as defined in the claims. For example to facilitate clear descriptions and illusrations of the invention features only plain and simple cylindrical/circular type, bolts,. large knobs, small knobs, trunions, small openings, enlarged openings etc. have been shown and discussed.

What is claimed is:

1. A locking mechanism of the chain guard type for mounting on a door and on a frame riser against which said door closes, said mechanism comprising:

a lock for mounting on the riser which is actuated to open by a controlled access means such as a key;

a lock member capable of being secured to and released from the lock;

an elongated assembly attached to the lock member, comprising a flexible component, which is capable of being extended to a fixed maximum length;

a housing assembly mounted on the door, with means to engage a free end of the elongated assembly only at a position near a housing end furthest from the lock while the lock member is secured to the lock, and means to then retain and guide said engaged free end to a stop near a housing end closest to the lock;

wherein the improvement is to provide at least one additional means to engage the free end of the elongated assembly with a lengthened means to retain and guide the engaged said free end so that a new position of engagement is beyond reach of the free end of the elongated assembly when the lock member is secured to the lock, with a new stop now at least as close to the lock as in the first mentioned means; and wherein the lock member is to be released from the lock whenever the free end of the elongated assembly is to be engaged or disengaged from the additional means in order to use a dead lock feature.

2. A mechanism as claimed in claim 1, wherein the elongated assembly has an adaptor means, attached to its free end.

3. A locking mechanism of the chain guard type for mounting on a door and on a frame riser against which said door closes, said mechanism comprising:

a lock for mounting on the riser which is actuated to open by a key;

a lock member capable of being secured to and released from the lock;

a chain assembly comprising said lock member fixed to one end of a chain, and a bolt fixed to the other end of said chain;

a bolt keeper mounted on the door, said keeper being formed with an elongated slot that runs from near a keeper side closest to the lock and terminates near a keeper side furthest from said lock in an opening;

wherein the improvement is to provide at least one additional longer elongated slot that runs from a position at length as close to the lock as the first slot and terminates in an enlarged opening, which is further away from said lock than the first opening so that when the lock member is secured to the lock the bolt is unable to be engaged or disengaged through said enlarged opening in said additional slot; and wherein the lock member is to be released from the lock whenever the bolt is engaged or disengaged through the enlarged opening in the additional slot so as to use a dead lock feature.

4. A mechanism according to claim 3, wherein the openings and bolt are circular in shape.

5. A lock mechanism of the chain guard type for mounting on a door and on a frame riser against which said door closes, said mechanism comprising:

a lock for mounting on the riser which is actuated to open by a controlled access means such as a key;

a lock member capable of being secured to and released from the lock;

an elongated assembly attached to the lock member, comprising a flexible component, which is capable of being extended to a fixed maximum length and terminates with an adapter at its free end;

a housing assembly mounted on the door, with means to engage the adapter of the elongated assembly only at a position near a housing end furthest from the lock while the lock member is secured to the lock, and means to then retain and guide said adapter to a stop near a housing end closest to the lock;

wherein the improvement is to increase the length of the means to retain and guide the adapter of the elongated assembly starting from the engagement means, in a direction away from the lock, and to introduce at least one additional different means to engage a different adapter, at the free end of the elongated assembly at a distance which is beyond reach of the different adapter, on the free end of the elongated assembly when the lock member is secured to the lock;

the different adapter compatible with the different means to engage, and not compatible with the first means to engage, and being attached siamese twin style to the first adapter at the free end of the elongated assembly; and wherein the lock member is to be released from the lock whenever the different adapter is to be engaged or disengaged from the different means to engage in order to use a dead lock feature.

6. A locking mechanism of the chain guard type for mounting on a door and on a frame riser against which said door closes, said mechanism comprising:

a lock for mounting on the riser which is actuated to open by a controlled access means such as a key;

a lock member capable of being secured to and released from the lock;

a chain assembly, comprising said lock member fixed to one end of a chain, and a bolt fixed to the other end of said chain;

wherein the improvement is said bolt having a small knob and a large knob;

a bolt keeper mounted on the door, said keeper being formed with an elongated slot that runs from near a keeper side closest to the lock and terminates near a keeper side furthest from said lock in an enlarged opening which is beyond the reach of the bolt so that the large knob cannot be engaged or disengaged to the slot when the lock member is secured to the lock, and a smaller opening along the slot located so that the small knob of the bolt can be readily engaged in said smaller opening;

wherein the lock member is to be released from the lock whenever the bolt is engaged or disengaged through the enlarged opening while using a dead lock feature.

7. A mechanism according to claim 6, wherein the openings and knobs are circular in shape.

* * * * *